United States Patent [19]

Greenwell

[11] Patent Number: 4,660,353

[45] Date of Patent: Apr. 28, 1987

[54] INTERMITTENT MOTION CARTONING APPARATUS FOR CARTONING LIQUID-FILLED POUCHES

[75] Inventor: Joseph D. Greenwell, Florence, Ky.

[73] Assignee: R. A. Jones & Co. Inc., Covington, Ky.

[21] Appl. No.: 745,633

[22] Filed: Jun. 17, 1985

[51] Int. Cl.[4] ..... B65B 43/13

[52] U.S. Cl. ..... 53/449; 53/175; 53/374; 53/383; 53/452; 206/217; 229/7 S

[58] Field of Search ..... 53/128, 141, 170, 175, 53/242, 244, 374, 383, 449, 452, 526, 527, 564; 83/98, 99; 206/217; 220/403; 229/7 S; 493/73, 80, 81, 100

[56] References Cited

U.S. PATENT DOCUMENTS

| | | | |
|---|---|---|---|
| 2,309,760 | 2/1943 | First | 53/449 |
| 2,365,159 | 12/1944 | Walton et al. | 53/449 |
| 3,036,415 | 5/1962 | Ayres et al. | 53/170 |
| 3,269,635 | 8/1966 | Bergstein et al. | 53/449 |
| 3,314,210 | 4/1967 | Järund | 53/175 |
| 3,580,120 | 5/1971 | Adams | 83/98 |
| 3,680,419 | 8/1972 | Stoop | 83/98 |

FOREIGN PATENT DOCUMENTS

| | | | |
|---|---|---|---|
| 670982 | 4/1952 | United Kingdom | 229/7.5 |

*Primary Examiner*—Robert L. Spruill
*Assistant Examiner*—Donald R. Studebaker
*Attorney, Agent, or Firm*—Wood, Herron & Evans

[57] ABSTRACT

Apparatus for cartoning liquid-filled pouches. A horizontal intermittent motion cartoner conveys cartons in a vertical orientation. At a first station, a hole is formed in a lower major flap. At a second station, glue is applied in a circular pattern around the hole. The flaps are then closed with the glue exposed to the inside bottom of the carton. A liquid-filled pouch is deposited by gravity into the carton. The upper portion of the pouch is tamped within the carton and the upper flaps closed and sealed.

9 Claims, 13 Drawing Figures

INTERMITTENT MOTION CARTONING APPARATUS FOR CARTONING LIQUID-FILLED POUCHES

This invention relates to apparatus for cartoning liquid-filled pouches. More particularly, the invention relates to cartoning of pouches filled with a soft drink, the carton and pouch being arranged to permit a straw to pass through the cartoning flaps and through the pouch.

A currently popular way of merchandising soft drinks is to provide a paperboard carton having an inner liner and to provide for the insertion of a straw through the paperboard carton, the straw puncturing the liner so that the contents of the liner can be extracted through the straw. The method of forming the carton with a liner in it and thereafter filling and sealing the liner and carton is expensive and requires complex, relatively slow machinery.

An objective of the present invention has been to form a liquid-filled carton taking advantage of known pouch-forming apparatus as well as conventional intermittent motion vertical cartoning techniques. By modifying the existing cartoning apparatus to accommodate the requirements of the liquid-filled pouch, it is possible to form and fill the pouches separately and thereafter to carton the pouches with consequent saving of cost and introduction of higher speeds through the utilization of known equipment. The combining of pouch-forming apparatus to form liquid-filled pouches and cartoning apparatus to produce the desired combined product is not without its problems. The pouch must be gotten into the carton so that it completely fills the carton and so that it can be penetrated by a straw. The problem is solved in part by the method and apparatus for forming the bottom of the carton while it is in the cartoner. (In the cartoner, the carton is inverted so that that which is formed as the bottom of the carton in the cartoner becomes the top of the carton when in use.)

The carton has at each end opposed major flaps along the longitudinal edges of the carton and opposed dust flaps along the transverse edges of the carton. The outer major flap has a plurality of die-cut sectors which may be easily penetrated by a straw. The inner major flap has a die-cut portion by which a hole can be created and through which a straw can pass when in use. To prepare the carton to receive a pouch and to carton it requires apparatus of the present invention as follows:

The cartoning apparatus has a station in which a blast of air is directed at the die-cut inner major flap to blow out a disc and thus form a hole.

An adjacent station has a hot melt glue applicator with a nozzle designed to create a circular pattern of tacky glue around the earlier-formed hole.

Succeeding stations fold the inner major flap first, and thereafter fold the dust flaps across the bottom of the carton. A glue stripe is applied to the dust flaps and an exposed portion of the inner flap. Finally, the outer major flap is folded and sealed across the bottom of the carton. While the concept of folding the dust flaps between the major flaps is not novel per se, it is nevertheless a highly unconventional way of closing a carton, the normal closing being first to fold the dust flaps across the carton and thereafter the major flaps.

The foregoing method and apparatus creates a carton which is vertically open with its bottom flaps closed and sealed in such a way as to expose, in the bottom of the carton, the tacky glue.

Another objective of the invention is to deposit the pouch reliably into the carton. The pouch is formed in such a way as to create seals or fins along its side and top edge with the bottom of the pouch presenting an unsealed, relatively smooth, surface. It is that relatively smooth surface which is to be adhered to the tacky glue and subsequently punctured with a straw by the ultimate user.

The material from which the pouch is formed must be thin enough to be puncturable and to keep material costs low. When filled with eight ounces of liquid, for example, the pouch tends to take the shape that the liquid imparts to it. If the pouch is vertical, as it should be to be deposited into the vertical carton, the liquid tends to bulge the bottom of the pouch. The bulged bottom of the pouch tends to hang up on the carton, particularly given the requirement that the pouch, when sealed within the carton, must substantially completely fill the carton.

According to the present invention, pouches are conveyed to the cartoner single file in timed relation to the intermittent motion of the cartoner. Since cartons are fed from a pouch former and filler, an apparatus which is not precisely timed to the cartoner, the apparatus of the invention provides for the deposit of the pouches onto an inclined conveyor between transverse lugs on the conveyor. The inclined conveyor is timed to the cartoner. To be sure that the pouches are deposited between lugs rather than onto the transverse lugs, an endless belt gate immediately upstream of the inclined conveyor is adapted to be run at three speeds: normal, fast and slow. A detector notes the position of the pouch arriving on an infeed conveyor toward the gate and causes the gate to operate at that speed which will insure the deposit of the pouch in the correct position on the inclined conveyor. The gate is also pivotable out of the way of the incoming pouches so as to eject those which are so badly out of time that they cannot be speeded or slowed for precise deposit between the lugs on the inclined conveyor.

The apparatus of the invention also provides for the flattening of the pouches as they are conveyed up the inclined conveyor, thereby eliminating any bulging which may have occurred in the earlier conveying of pouches.

A substantially vertical chute is provided between the discharge end of the inclined conveyor and a vertical carton momentarily held stationary in the cartoner below the chute. The chute is configurated to guide the pouch into the carton and preferably to fold the lower corners of the pouch upwardly to minimize the possibility of their hanging up on the upper edge of the carton. The chute also includes a central antifriction rail which minimizes the friction between the chute and the pouch as the pouch slides down the chute. If the friction is too great, the liquid in the pouch will tend to move downwardly faster than the pouch itself, thereby causing the pouch to bulge at its bottom.

The foregoing apparatus deposits the pouch into the carton in such a way that the uninterrupted surface of the bottom of the pouch engages and adheres to the tacky circular pattern of glue surrounding the hole at the bottom of the pouch.

Keeping in mind both the need for the pouch to substantially completely fill the carton and the finned upper edge of the pouch created during the pouch-forming, there is a need to tamp the upper end of the pouch into the carton prior to closing of the flaps. This is accomplished by a three-stage tamper. A first tamper depresses the center of the upper end of the pouch, causing the finned corners to move together. At a second station, an inverted U-shaped tamper cams those corners toward each other. At the third station, a flat tamper folds the corners down upon the top of the pouch. The thus tamped pouch can be sealed into the carton by conventional flap folding, gluing and sealing mechanism on the cartoner.

The several features and objectives of the present invention will become more readily apparent from the following detailed description taken in conjunction with the accompanying drawings in which.

GENERAL ORGANIZATION AND OPERATION

Figure 1:
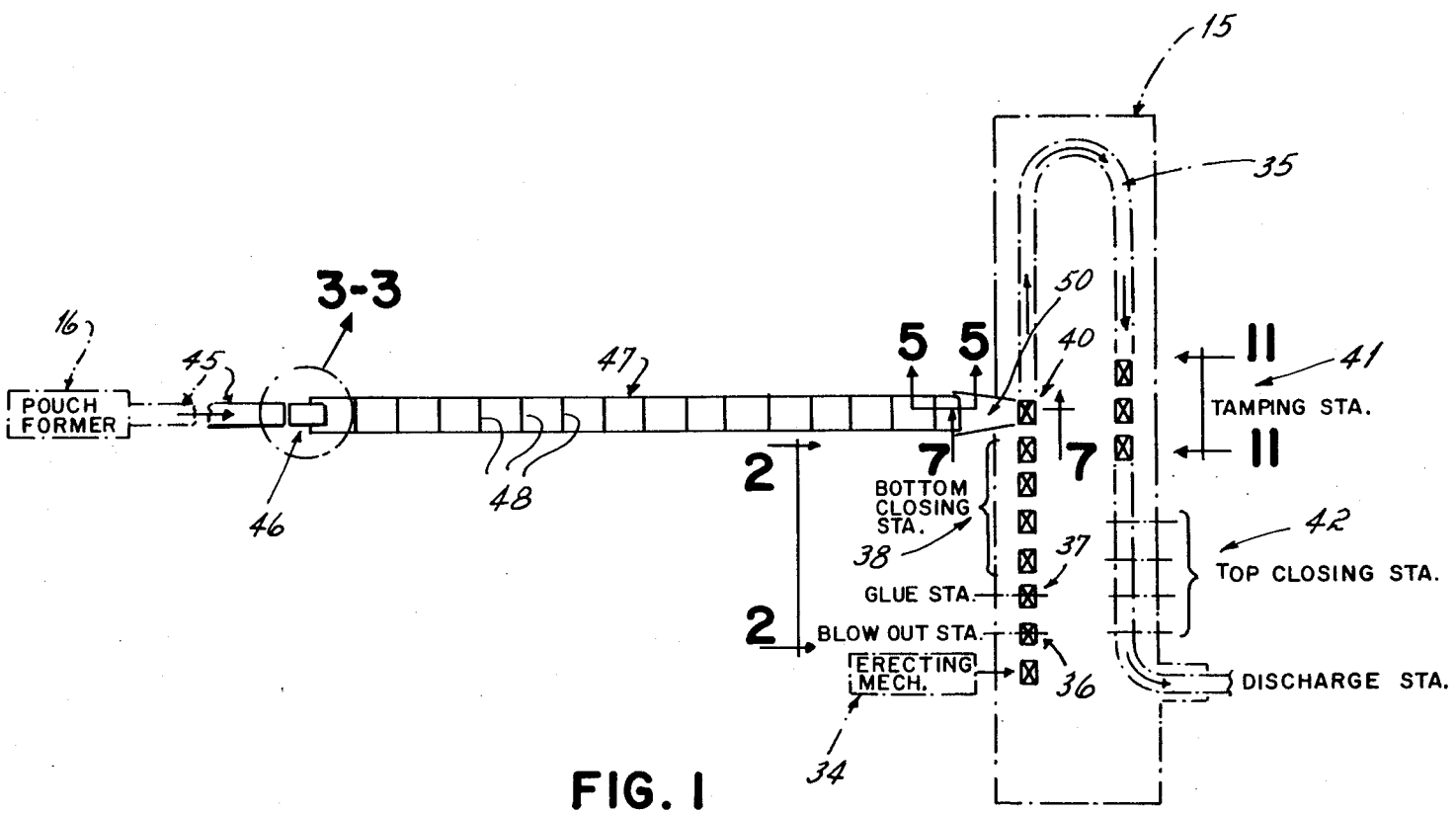
FIG. 1 is a diagrammatic plan view of the complete apparatus of the invention.

Referring to FIG. 1, a cartoner is shown at 15, the carton being fed by a pouch-former indicated at 16.

The pouch-former forms liquid-filled pouches 18 (FIGS. 5 and 6), the pouches being sealed along vertical edges 19 and a top edge 20. The bottom 21 of the pouch is smooth or uninterrupted.

Figure 2:
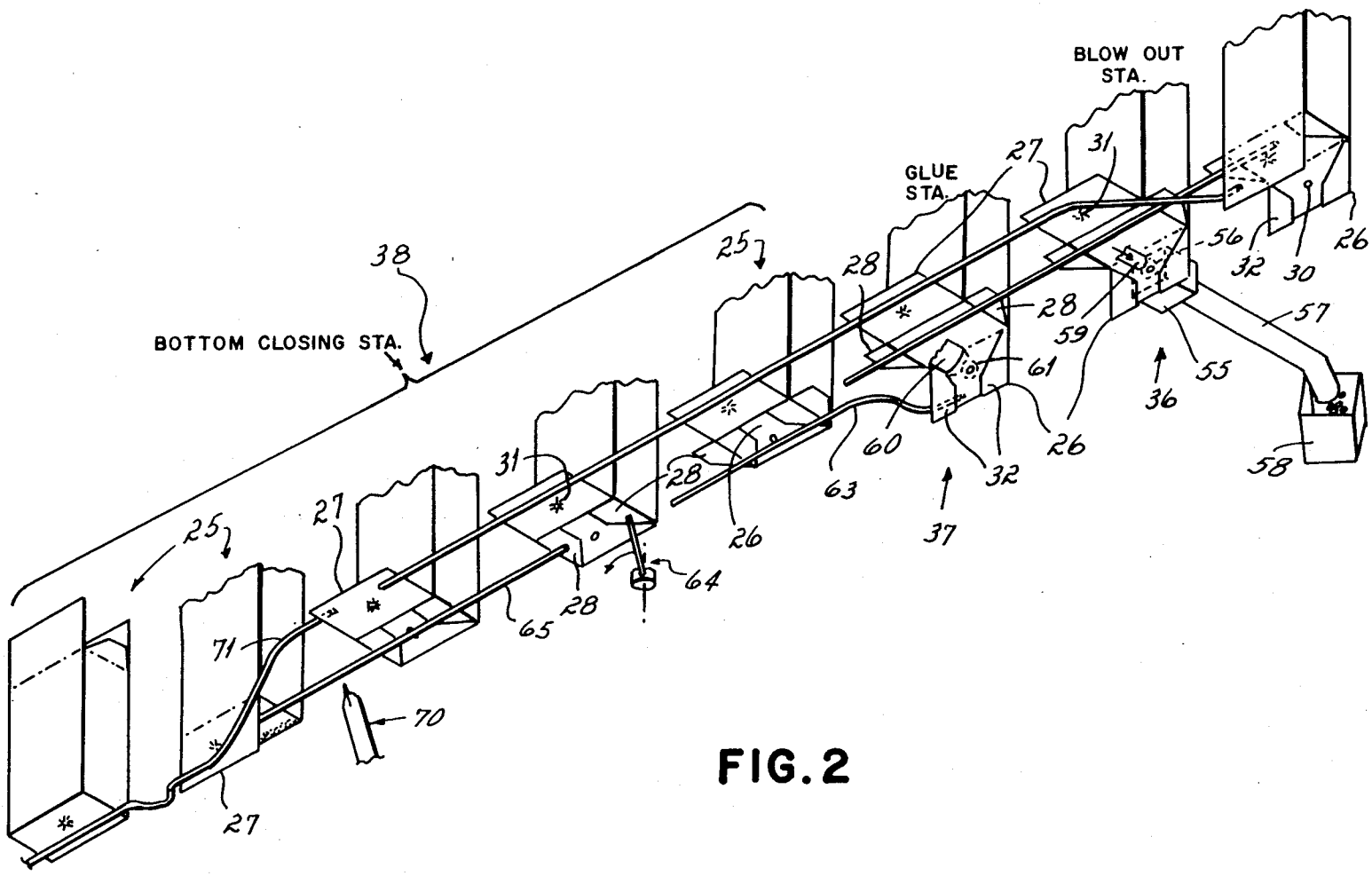
FIG. 2 is a diagrammatic perspective view of the apparatus which forms the bottom of the carton taken along lines 2—2 of FIG. 1.

Cartons into which the pouches are to be deposited are best shown in FIG. 2 at 25. Each carton has an inner major flap 26, an outer major flap 27, and a pair of opposed dust flaps 28. The inner major flap is die-cut at 30 to create a disk which, when removed, forms a hole in the inner major flap. The outer major flap is die-cut as shown at 31 to create sectors which may easily be forced inwardly by a straw at the time the cartoned product is in use. The inner major flap has lateral debossed areas 32 which enable the flap to fit around the dust flaps at the time of closing to provide assurance of good sealing of the carton.

The cartons are erected into a vertical orientation by erecting mechanism not shown indicated diagrammatically at 34 in FIG. 1. The cartons are moved in an intermittent motion along the path of intermittent motion conveyor 35 shown in FIG. 1.

The cartoner has several stations at which distinct operations are performed. At a blow-out station 36, the disk is blown away from the die-cut portion 30, leaving a hole in the inner major flap. At glue station 37, a circular pattern of a tacky pressure-sensitive glue is deposited around the hole formed in the inner major flap. At the station 38, the inner major flap is closed across the bottom of the carton, the dust flaps are closed across the inner major flap, a glue strips is applied across the dust flaps and the inner major flap and the out major flap is closed and sealed upon the dust flaps and inner major flap.

At station 40, the pouches are loaded by gravity into the cartons. At station 41 the upper finned edges of the pouches are tamped into the cartons. At station 42 the top of the carton is closed by conventional apparatus not shown.

The pouches 18 are delivered from the pouch-former on an infeed conveyor 45. At the discharge end of the infeed conveyor is a timing gate 46. The timing gate deposits pouches onto an inclined conveyor 47 which has a series of transversely spaced lugs 48 between which the pouches are deposited. The discharge end of the inclined conveyor 47 is elevated and deposits cartons into a chute 50 which in turn guides the pouches into the open ends of the cartons at the filling station 40.

In operation, the cartons are erected and positioned on the conveyor 35. A hole is blown out of the inner major flap at station 36. Tacky glue is deposited around the hole at station 37. The bottom of the carton is closed with the glue being exposed at the inner bottom of the carton at station 38. Pouches conveyed from the infeed conveyor and up the inclined conveyor 47 are caused by the chute 50 to be deposited into the carton with the smooth bottom 21 of the pouch adhering to the tacky glue. The upper finned edges of the pouches are tamped into the cartons at station 41. The flaps forming the top of the carton are closed at station 42.

HOLE BLOW-OUT STATION

Referring to FIG. 2, the hole blow-out station 36 inclines an anvil 55 having a central bore 56 therethrough. The central bore is connected to a discharge tube 57 which leads to a waste receptacle 58 in which the disks blown out of the inner major flap are collected. A nozzle 59 is positioned directly opposite the bore 56 in the anvil 55 and spaced from it a distance which is just sufficient to permit the inner major flap 26 to pass between the nozzle and the anvil. When the carton pauses at station 36 with the die-cut portion 30 aligned with the bore 56, a jet of air from the nozzle 59 blows the disk out of the inner major flap, thereby creating a hole through which a straw may be inserted.

GLUE STATION

At glue station 37, a glue nozzle 60 is positioned. The glue nozzle has a circular pattern of orifices through which glue is driven. When the carton 25 pauses at the glue station 37, the pattern of tacky glue indicated at 61 is deposited to surround the hole 30.

CLOSING AND SEALING STATION

A plow 63 folds the inner major flap 26 across the bottom of the carton. Downstream of the plow 63 is a rotating dust flap closer 64 and a plow 65 to close the dust flaps 28 on top of the inner major flap 26. A glue nozzle 70 is located in the path of the carton 25 to deposit a stripe of glue across the dust flaps and exposed portion of the inner major flap as a the carton moves between stations.

Finally, a plow 71 engages and closes the outer major flap 27 causing it to adhere to the glue stripe.

INFEED GATE

Figure 3:
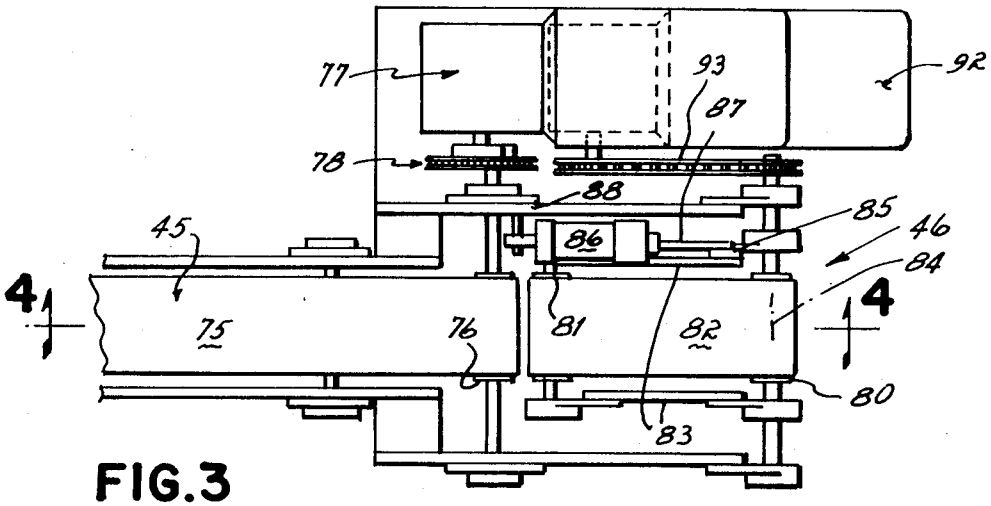
FIG. 3 is a fragmentary plan view of the infeed conveyor and the timing gate taken at the encircled portion 3—3 of FIG. 1.
Figure 4:
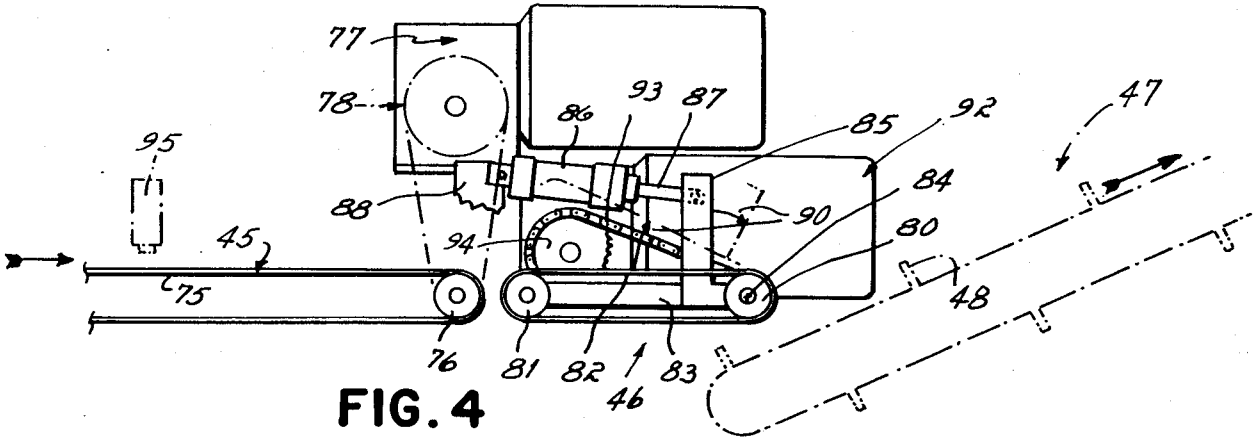
FIG. 4 is a cross-sectional view taken along lines 4—4 of FIG. 3.

Referring to FIGS. 3 and 4, the infeed conveyor 45 and gate 46 are shown. The infeed conveyor is an endless belt 75 driven by a pulley 76 which is in turn driven by a motor 77 through a chain and sprocket 78 at substantially uniform speed. The infeed conveyor receives filled pouches from a conventional pouch form-fill-seal machine.

The gate 46 is immediately adjacent the downstream end of the infeed conveyor 45. The gate includes a driving pulley 80 and an idler pulley 81 around which an endless belt 82 passes. The pulleys are mounted on a frame 83 which is pivoted around axis 84 which is also the axis of the driving pulley 80. The frame 83 is connected to a vertical arm 85. A double-acting piston and cylinder 86 has its piston rod 87 pivotally connected to the arm 85 with its other end being pivotally connected to a stationary bracket 88. When the piston and cylinder is actuated to extend the piston rod, the gate pivots to an upper broken line position as indicated by the arrow 90, thus creating a gap at the discharge end of the infeed conveyor 45. That gap permits pouches which are not sufficiently well timed to the lugs 48 of the inclined conveyor 47 to be ejected.

The driven pulley 80 is connected to a variable speed drive motor 92 by a chain 93 and sprocket 94. The variable speed motor can be operated at a normal speed wherein the upper flight of the belt 80 has substantially the same linear speed as the belt 75; a fast speed wherein the belt 82 is substantially faster than the belt 75; and a slow speed wherein the belt 82 is driven at a substantially slower speed than the belt 75. A detector 95 is positioned along the infeed conveyor to detect the position of an incoming pouch relative to the lugs 48 of the inclined conveyor 47. If the pouch is positioned to be deposited between the lugs, belt 82 will continue to run at normal speed. If the pouch is slightly out of sync with the lugs, the belt 82 will be speeded or slowed as required to deposit the pouch between lugs. If a pouch is so badly out of sync that the variation in the speed of the belt 82 cannot deposit the pouch into the pocket between the lugs 48, the piston and cylinder 86 will be actuated to eject that pouch.

POUCH FLATTENER

Figure 6:
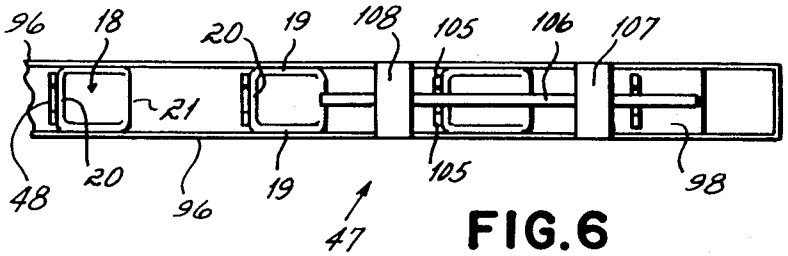
FIG. 6 is a plan view of the upper end of the inclined conveyor taken along lines 6—6 of FIG. 5.
Figure 5:
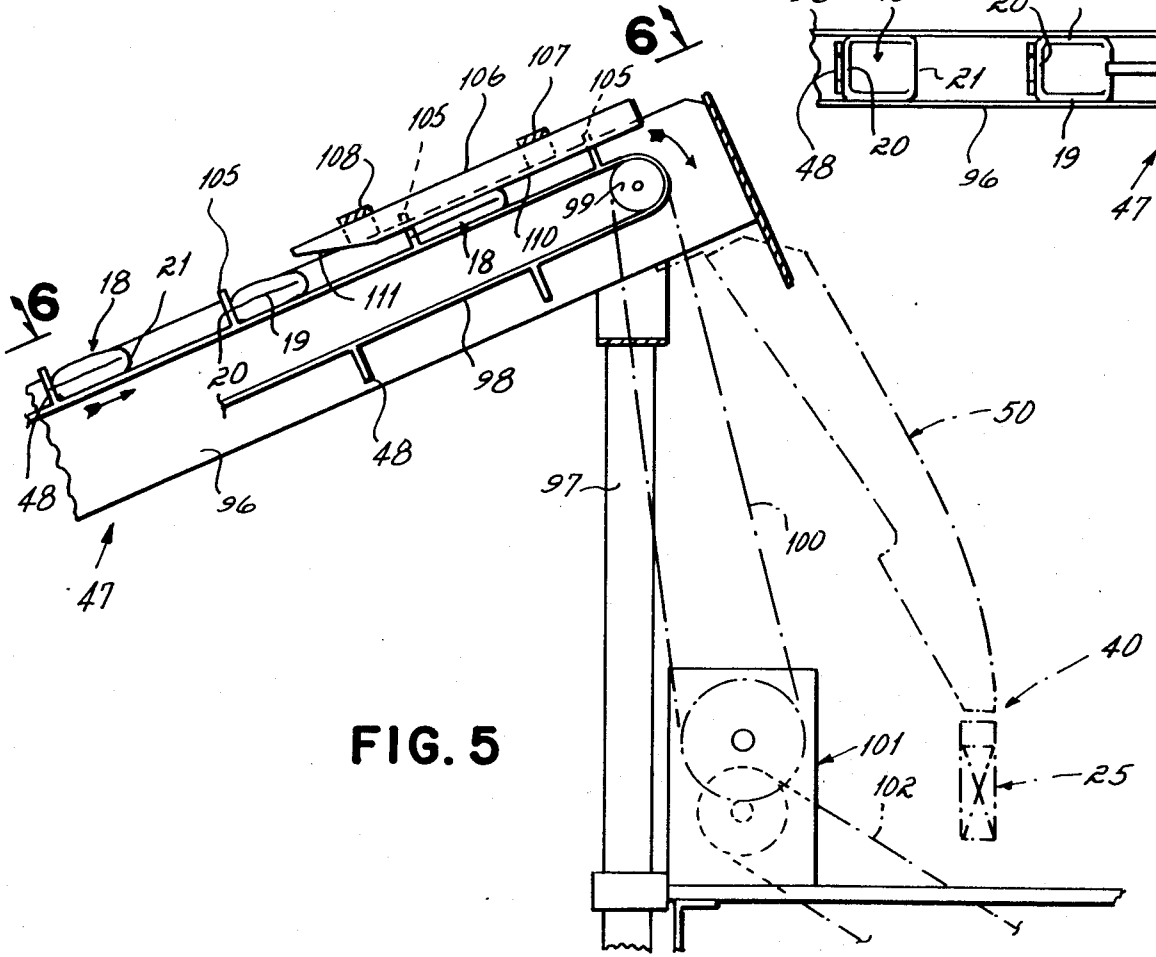
FIG. 5 is a cross-sectional view, partly in elevation, of the discharge end of the inclined conveyor taken along lines 5—5 of FIG. 1.

Referring to FIGS. 5 and 6, the inclined conveyor 47 includes a frame 96 whose upper end is supported on a post 97. Within the frame 96 is an endless belt 98 passing around pulleys at each end, a driving pulley 99 being shown in FIG. 5. The driving pulley is driven by a chain 100 which is in turn driven by the mechanism 101 timed to the cartoner by a chain 102.

The lugs 48 on the inclined conveyor 47 are U-shaped and present upwardly-projecting legs 105. An elongated bar 106 is mounted by upper and lower brackets 107 and 108 to the frame 96 for the inclined conveyor. The bar 106 projects downwardly between the legs 105 on the lugs 48 and has a lower surface 110 which is upwardly-tapered at 111 at its upstream end. The elongated bar 106 is spaced from the surface of the endless belt 98 by a distance sufficient to flattern the pouches 18 as the pouches pass under the bar. Thus, as the pouches pass over the discharge end of the inclined conveyor 47, the undesirable bulges are substantially removed. As the pouches pass over the discharge end of the inclined conveyor, they are received by the chute 50.

THE CHUTE

Figures 7, 8, 9, 10:
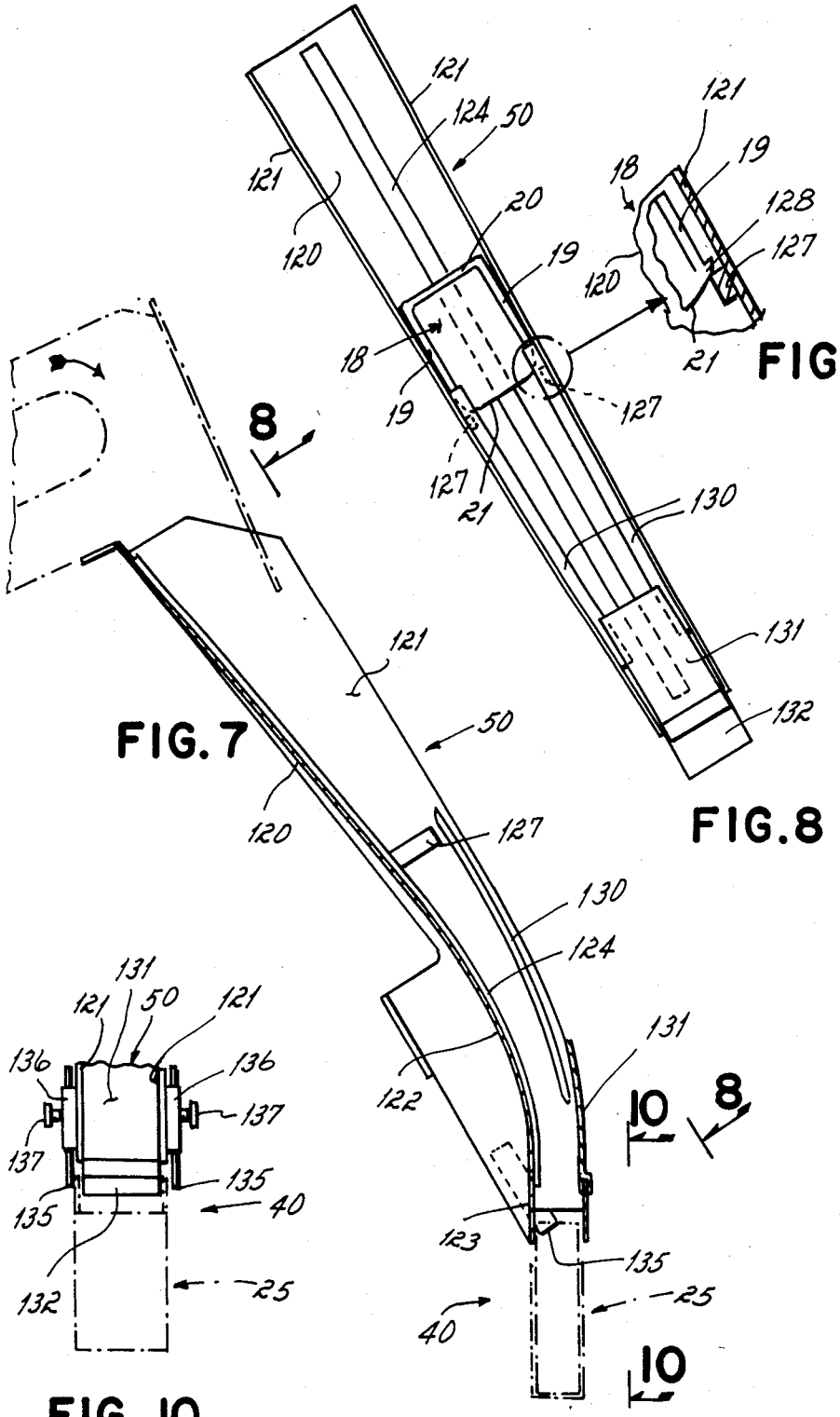
FIG. 7 is a cross-sectional view partly in elevation, of the chute between the discharge end of the inclined conveyor and the carton taken along lines 7—7 of FIG. 1.
FIG. 8 is an elevational view taken along lines 8—8 of FIG. 7.
FIG. 9 is an enlarged view from the encircled area of FIG. 8.
FIG. 10 is an elevational view taken along lines 10—10 of FIG. 7.

The chute 50 is shown in FIGS. 8–10. It includes a bottom wall 120 and downwardly and inwardly tapering side walls 121. The upper portion of the bottom wall 120 lies at an angle of about 50° to a horizontal plane. The lower end of the bottom wall has an arcuate section 122 which terminates in a substantially vertical discharge end 123. A Teflon strip 124 is secured to the center of the bottom wall 120 and provides an antifriction surface upon which the pouches ride as they descend from the top end of the chute into a carton 25 positioned underneath the chute by the carton transport conveyor 35. Optionally, a pair of lugs 127 are mounted on the side walls 121 intermediate the ends of the chute. The lugs 127 are located close to the bottom wall and in position to engage the finned corners 128 of each pouch 18 as the pouch passes by the lugs (FIG. 9). The finned corners are thus bent rearward slightly so as to facilitate the entry of the pouch into the carton.

Overlying the arcuate portion 122 of the bottom wall 120 are a pair of rails 130 which confine the pouch within the chute as it moves around the curved bottom wall. A plate 131 is frictionally and removably mounted on a bracket 132 fixed to the lower end of the chute and spaced from the bottom wall to confine the pouch within the chute and to guide it into the carton. A pair of vertically adjustable tabs 135 are mounted on the side walls in holders 136. The holders 136 have set screws 137 to clamp the tabs into the desired vertical position. The tabs, coupled with the side walls, serve to confine the dust flaps against impact from the lower corners 138 of the pouch as the pouch passes into the carton 25.

In the operation the chute, the pouch, previously flattened on the inclined conveyor, is dropped onto the Teflon strip 124 of the chute and slides substantially frictionlessly down the chute toward the carton 25 below. If the side lugs 127 are employed, the lower corners 128 of the pouch are folded upwardly so as to facilitate the entry of the pouch into the carton. Because the pouch per se is substantially free of friction, the tendency of the liquid within the pouch to force the pouch to bulge at its lower end is minimized. Thus, the pouch passes freely into the carton 25 where it engages and adheres to the tacky glue.

TAMPING SECTION

Figure 11:
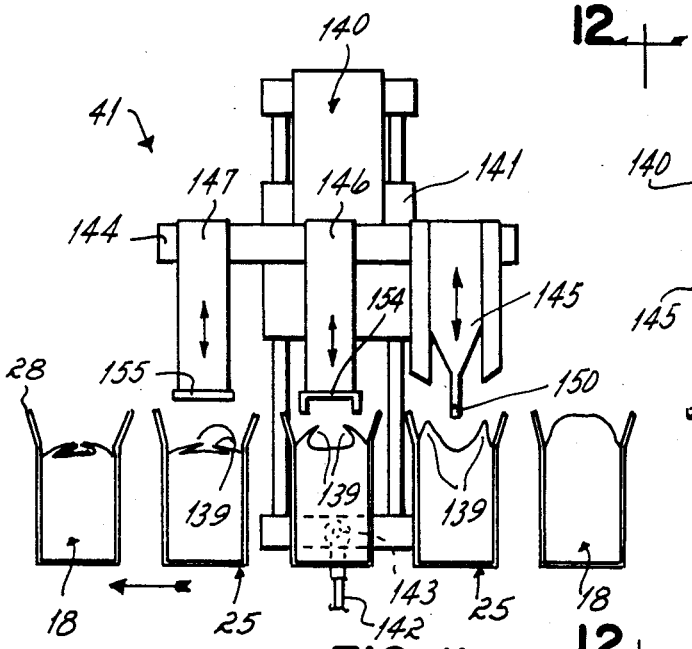
FIG. 11 is a diagrammatic elevational view, partly in section, of the tamping apparatus taken along lines 11—11 of FIG. 1.
Figure 12:
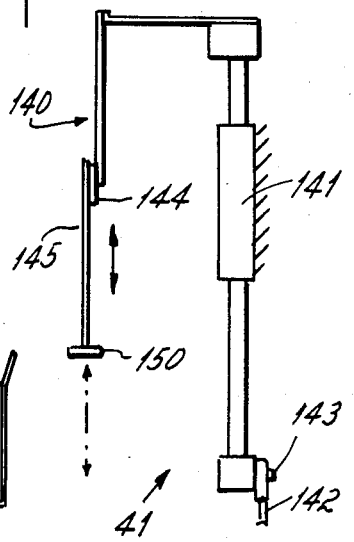
FIG. 12 is a side elevational view taken along lines 12—12 of FIG. 11.

Following introduction of the pouch into the carton, the cartons are advanced to a tamping section 41. At the tamping section, the finned upper edge 139 of the pouch is to be tucked into the carton so that the fin of the pouch does not impede the operation of the conventional flap-closing mechanisms. A plunger 140 is slidably mounted in a bracket 141 and is raised and lowered by a crank arm 142 timed to the cartoner and pivoted at 143 to the lower end of the plunger. A cross bar 144 carries three spaced tamp heads 145, 146 and 147. The tamp heads are spaced apart by the distance between adjacent cartons. The upstream tamp head 145 which first engages the pouch has a thin cross bar 150 at its lower end. The cross bar engages the center of a pouch to depress it as shown in FIG. 11 into a V shape, causing the upper finned corners 139 to flex toward each other.

The second tamp head has an inverted U-shaped element 154 at its lower end. When it is moved downwardly into contact with the pouch, it forces the corners 139 further downwardly and inwardly as shown in FIG. 11.

The final tamp head is a flat plate 155 slightly smaller in dimension than the inside cross section of the carton. That plate, when moved downwardly, forces the finned corners 139 to lie substantially flat across the upper end of the carton as shown in FIG. 11. Thus, the pouch is positioned in the carton, substantially completely filling it, with the fins, however, out of the way of the dust flaps and major flaps so that the carton can be closed and sealed by conventional cartoning mechanism.

Figure 13:
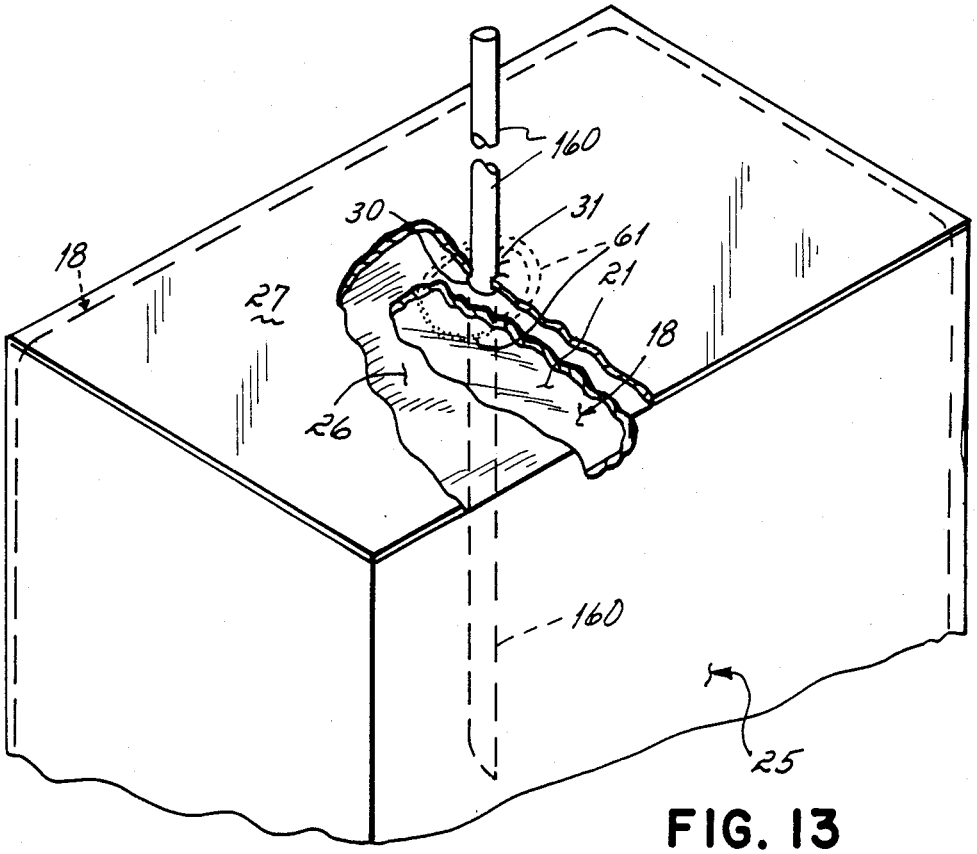
FIG. 13 is a perspective view of a filled and closed carton.

A completed carton is shown at FIG. 13. There, it can be seen that a pouch 18 completely fills the carton 25. At the upper end of the carton (the bottom end during filling), the pouch 18 is adhered to the inner major flap 26 by the beads of tacky glue 61. A straw 160 is shown as passing through the sectored opening 31 in the outer major flap 27 and through the hole 30 in the inner major flap. The straw punctures the smooth end 21 of the pouch so that the liquid in the pouch can be extracted through the straw.

From the above disclosure of the general principles of the present invention and the preceding detailed description of a preferred embodiment, those skilled in the art will readily comprehend the various modifications to which the present invention is susceptible. Therefore, I desire to be limited only by the scope of the following claims and equivalents thereof:

I claim:

1. Apparatus for cartoning liquid-filled pouches having sealed seams along left vertical, right vertical and top edges and a smooth bottom edge into cartons having at one end inner and outer opposed major flaps and opposed dust flaps, said carton having an end remote from said one end and adapted to receive a liquid-filled pouch therethrough, the apparatus comprising:

a cartoner having the following stations:

(a) means for blowing a die-cut disk out of a carton inner major flap to form a straw hole;

(b) means for applying glue in a circular pattern around the hole formed in the inner major flap;

(c) means for first folding said inner major flap across the end of the carton;

(d) means for folding the dust flaps over said inner major flap;

(e) means for applying a glue strips across said dust flaps and inner major flap;

(f) means for folding said outer major flap across the end of said carton into contact with said glue stripe;

(g) means for depositing a liquid-filled pouch bottom first into the carton through the remote end of the carton; and means for conveying cartons through said stations.

2. Apparatus as in claim 1 in which said means for blowing said disk comprises:

an anvil having a bore therethrough alignable with said die-cut disk;

an air nozzle spaced from said anvil a distance just sufficient to permit a carton flap to pass between said nozzle and said anvil;

means for directing a jet of air through said nozzle to drive said disk out of said flap and through said bore.

3. Apparatus as in claim 2 further comprising:

a discharge tube connected to said anvil adjacent said bore to convey said disks to a waste receptacle.

4. Apparatus as in claim 1 in which said first named glue-applying means comprises:

means for melting a glue which remains permanently tacky upon cooling;

a nozzle having a plurality of orifices defining a circle of a diameter slightly greater than the diameter of said disk;

said nozzle being positioned in the path of said inner major flap;

and means for directing said glue through said orifices onto said inner flap when it is positioned opposite said nozzle.

5. The apparatus of claim 1 further including the following station:

(h) means for tamping a pouch into the carton such that an upper portion of each said vertical seam of said pouch is folded towards the other.

6. The method of cartoning a liquid-filled pouch having sealed seams along left vertical, right vertical and top edges and a smooth bottom adapted to be penetrated into a carton having at one end opposed inner and outer major flaps, the inner of which has a circular die cut and a pair of dust flaps, the carton having an end remote from the one end and adapted to receive a liquid-filled pouch therethrough, the method comprising:

blowing away the disk formed by the circular die cut to create a hole in the inner flap;

applying a substantially closed ring of tacky glue on the inner surface of said inner major flap surrounding said hole;

folding said inner flap across the end of said carton;

folding said dust flaps across the end of said carton;

applying a glue stripe to said inner major flap and said dust flaps;

folding said outer major flap across said carton;

dropping a pouch bottom first into said carton through said remote end thereof;

and closing the remote end of said carton.

7. The method as in claim 6 further comprising the steps of tamping said pouch into said carton such that an upper portion of each said vertical seam of said pouch is folded towards the other prior to closing said remote end of said carton.

8. Cartoning apparatus for cartoning flexible pouches containing soft drinks into cartons having opposed major flaps and opposed dust flaps, the pouches having sealed, seams along left vertical, right vertical and top edges and a smooth bottom edge said apparatus comprising:

a horizontal carton conveyor for conveying cartons in a vertical orientation;

means for forming a hole in a lower major flap;

means for applying tacky glue around said hole;

means for closing the bottom flap of said carton with said tacky glue exposed inside the bottom of said carton;

means for conveying soft drink-filled pouches to said carton conveyor in a position to be deposited bottom first into said carton, said conveyor including means for elevating said pouches, and a chute for dropping said pouches into a carton whereby the smooth bottom edge of the pouch will contact the tacky glue;

means for tamping the upper portion of said pouch into said carton, and means for closing and sealing the flaps in the top of said carton.

9. Apparatus as in claim 8 in which said elevating means includes means for flattening said pouches.

* * * * *